US005171108A

United States Patent [19]

Hugron

[11] Patent Number: 5,171,108

[45] Date of Patent: Dec. 15, 1992

[54] GROUND ANCHOR

[76] Inventor: Denis P. Hugron, 1855, Georges, St-Hubert, Quebec, Canada, J4T 1W2

[21] Appl. No.: 864,058

[22] Filed: Apr. 6, 1992

[51] Int. Cl.[5] ..... E02D 5/80

[52] U.S. Cl. ..... 405/259.1; 405/244; 52/163; 52/166

[58] Field of Search ..... 52/162, 163, 166; 405/19, 172, 244, 259.1

[56] References Cited

U.S. PATENT DOCUMENTS

| | | | |
|---|---|---|---|
| 855,298 | 5/1907 | Frost | 52/163 |
| 1,178,282 | 4/1916 | Wilcox | 52/163 |
| 3,969,854 | 7/1976 | Deike | 52/163 |
| 4,574,539 | 3/1986 | Deike | 52/163 |
| 4,611,446 | 9/1986 | Beavers et al. | 405/259.1 X |
| 4,688,360 | 8/1987 | Luong et al. | 52/163 X |
| 4,738,063 | 4/1988 | Alsop | 52/155 X |
| 5,123,779 | 6/1992 | Miller | 405/19 |

FOREIGN PATENT DOCUMENTS 1045331 1/1979 Canada .

2470823 6/1981 France .

*Primary Examiner*—Randolph A. Reese
*Assistant Examiner*—Arlen L. Olsen
*Attorney, Agent, or Firm*—Roland L. Morneau

[57] ABSTRACT

A ground anchor adapted to be driven into the ground comprises an elongated flat plate having a first bent portion at one end forming a U-shaped throat along one side of the plate and a second bent portion at the end opposite the first mentioned end slightly inclined relative to the flat surface of the plate in the direction opposite the throat. A cable is secured at one of its ends, to the plate, at an intermediate portion between both ends of the plate. The intermediate portion is located in the direction of the second bent portion relative to the center of gravity of the plate. The end of the cable forming a closed loop has an aperture adjacent the plate and on the same side of the plate as the throat. The loop and the throat are adapted to upstandingly retain the rod while the latter is impacted for driving the anchor into the ground, and the plate is adapted to tilt about the loop when the cable is pulled upwardly thereby imparting a plowing effect of the plate in the ground.

5 Claims, 2 Drawing Sheets

GROUND ANCHOR

BACKGROUND OF THE INVENTION

1. Field of the Invention

The invention is directed to a ground anchor adapted to be driven in the ground. A cable which is attached to the anchor extends above the ground. The anchor which is adapted to adopt a horizontal position when one pulls on the cable, constitutes retention means for various devices freely standing on the ground.

2. Prior art

The present invention is particularly an improvement over U.S. Pat. No. 3,969,854 issued on Jul. 20, 1979 and Canadian patent No. 1,045,331 issued on Jan. 2, 1979.

The manufacturing cost of the present device considerably reduces the manufacturing cost of prior similar devices while the penetration of the device in the ground is facilitated.

The anchor disclosed in Canadian patent No. 1,045,331 is directed to a ground anchor having a hollow tubular member which is driven into the ground by a rod inserted in the tubular member. The cost of a tubular member which needs to be solidly closed at one end is greater than for a flat plate which is merely bent at both ends. Furthermore, the tubular member requires an outer projection for hooking the cable. This outer projection further adds to the cost of the device.

SUMMARY OF THE INVENTION

The present invention is directed to a ground anchor adapted to be driven into the ground with a stiff rod. It is characterized by an elongated flat plate bent at one end along a transversal axis to form a U-shaped hook and bent at the end opposite the U-shaped hook. The U-shaped hook constitutes a throat for receiving the rod when the plate is driven into the ground. The bent portion at the opposite end is only sightly inclined relative to the plane of the plate in a direction opposite the throat. A cable is secured to the plate at an intermediate portion between both ends of the plate. This intermediate portion is located at the center of the plate and slightly in the direction of the second bent which is opposite the U-shaped hook. The cable forms a closed loop fixed to the plate. The aperture inside the loop and adjacent the plate is on the same side as the U-shaped throat. The ground anchor is adapted to be driven into the ground by the introduction of the stiff rod through the loop and into the throat while the plate is standing in a substantially vertical position. The cable which is sufficiently long to remain partly above the ground, will tilt the flat plate in a substantially horizontal position when being pulled upwardly thereby forming an anchor for implements hooked to the cable above the ground.

The U-shaped throat is shaped to allow the stiff rod to slide therein and the second bent portion forms a continuous curve with surface of the plate with its tip extending at a tangential angle of about 15 to 30 degrees relative to the flat surface of the plate. The cable is preferably hooked to the Plate through a pair of holes transversally provided in the intermediate portion of the plate and the end of the cable is secured to an adjacent portion of that latter end to form a loop sufficiently large to allow the rod to slide therein along the plane of the plate.

DETAILED DESCRIPTION OF THE INVENTION

Figure 4:
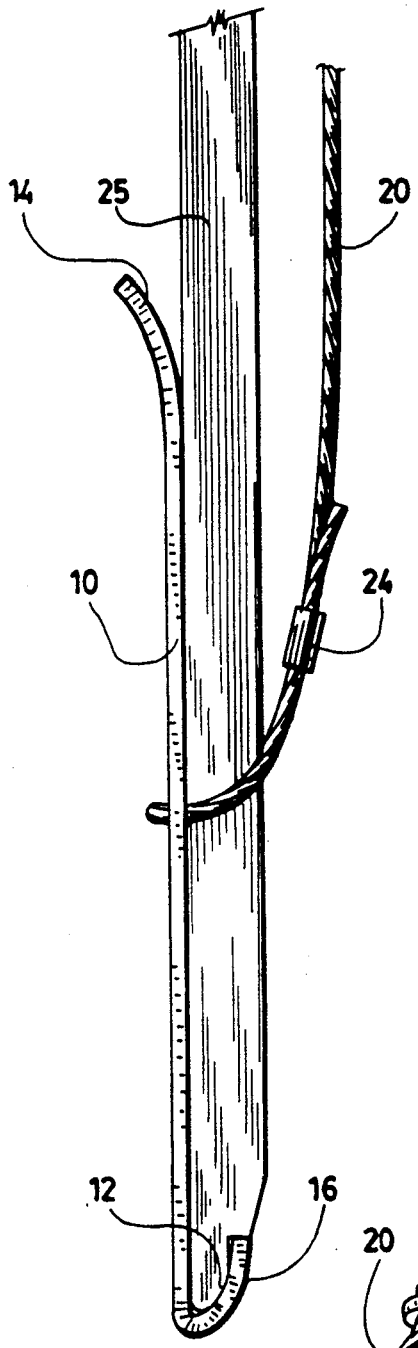
FIG. 4 is a side view of the anchor plate and the cable tied to an intermediate portion of the plate and the rod which is adapted to drive the plate in the ground.
Figure 5:
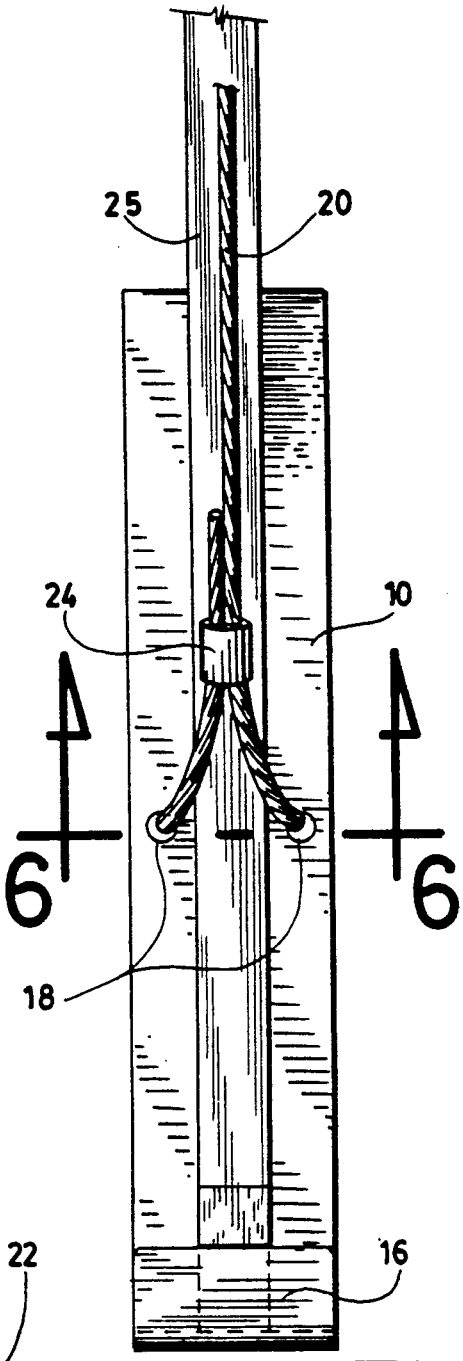
FIG. 5 is a front view of the combination shown in FIG. 4.
Figure 6:
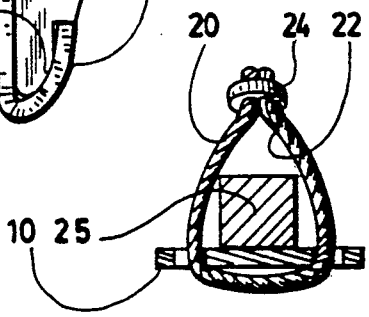
FIG. 6 is a cross-sectional view taken along line 6—6 of FIG. 5.

FIGS. 4, 5 and 6 illustrate an elongated flat plate having a U-shaped throat 12 at one end and a slightly bent portion 14 at the other end. The plate 10 is essentially flat between both ends and must be sufficiently stiff for the purpose intended so as to essentially maintain its flat shape. A steel plate is generally used. The U-shaped throat 12 is formed by a ledge 16 bent from the end portion of the plate along one side of the latter and substantially along an axis transversal to the longitudinal axis of the elongated plate 10. The bent portion 14 is inclined from the surface of the plate 10 in a direction opposite the U-shaped throat 12 and forms a smooth curve which extends up to a tangential direction of about 15 to 30 degrees relative to the surface of the flat surface of the plate 10.

The flat portion of the plate 10 is provided with a pair of holes 18 on each side of the central longitudinal axis of the plate and substantially about midway between both ends of the Plate. The holes are preferably closer to the bent portion 14 than to the hook 12. A cable 20 is tied to the plate 10 by extending through both holes 20 and forming a closed loop 22 on the side corresponding to the U-shaped throat 12.

The loop 22 is closed by tieing the end of the cable to an adjacent part with a clip 24 which tightly holds both parts of the cable 20.

Figures 1, 2, 3:
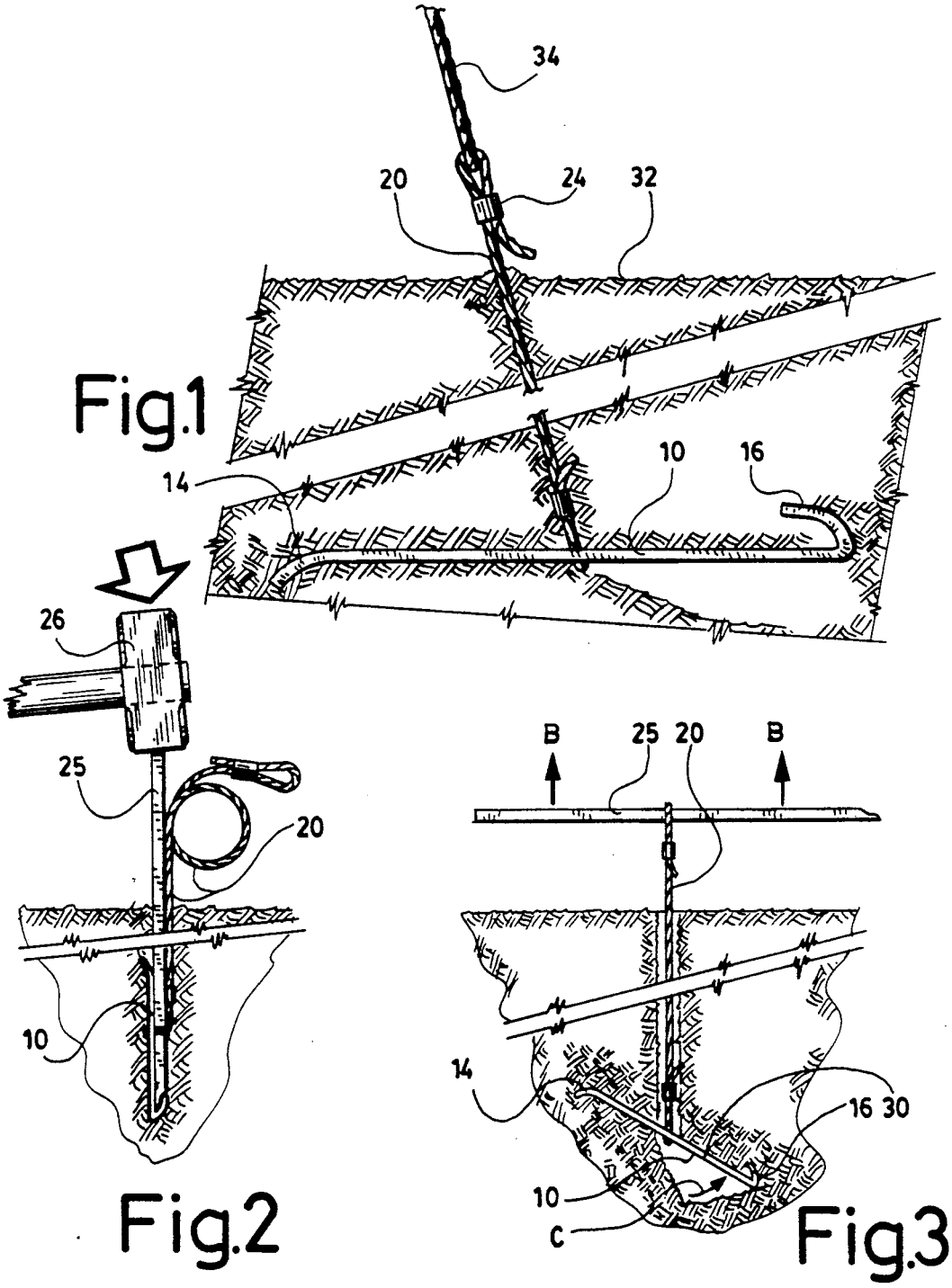
FIG. 1 is a cross-sectional view through the ground showing a ground anchor holding a cable extending above the ground.
FIG. 2 shows the ground anchor being driven in the ground by a stiff rod impacted by a sledge hammer.
FIG. 3 is a cross-sectional view through the ground showing the anchor plate being pulled by the cable for leveling the anchor plate.

The flat plate 10 combined with the cable 20 as described above, constitutes the essence of the invention. A rod 25 is used to drive the anchor plate 10 in the ground. The rod 24 which has a suitable cross-section is introduced through the loop 22 along the plate 10 until it engages the U-shaped throat 12. This arrangement maintains the plate 10 in a vertical direction while the rod 24 is impacted by a striking implement such as a sledge hammer 26 in the direction of arrow A. The plate 10 is driven into the ground to a depth of about 3 feet or to any depth which will allow the desired retention of the anchor while positioned according to the invention. Subsequently, the rod 25 is removed while the plate remains in the ground. Afterwards, means are used to pull on the cable 20 in the direction of arrows B as shown in FIG. 3. Such a traction on the cable has a tendency to tilt the plate 10 in a substantially horizontally position by rotating it in the direction of the arrow C. This tendency is particularly provoked by the bent portion 14 which ploughs and digs into the ground while the opposite end represented by the bent portion 16 will be pulled upwardly by the cable 20. Although the rotation of the plate 10 has a tendency of evacuating the earth, sand or the like in the region 30 under the plate 10, the amount of earth above the plate constitutes a solid abutment for the plate 10.

FIG. 1 shows the ground anchor 10 in a final position below the surface of the ground while the cable 20 extends upwardly at an angle relative to the surface of the ground 32. The degree of inclination of the cable 20 is selected when the cable is intended to hold another cable 34 having an angular traction or which is intended to hold onto a temporary housing (not shown) laterally positioned relative to the ground anchor.

The dimension of the plate varies according to the retention power required. Plates having a width of about one inch wide and 6 to 8 inches long are easy to drive into the ground and offer a positive retention. A plurality of ground anchors may be used around a temporary housing.

I claim:

1. A ground anchor comprising an elongated flat plate having a first bent portion at one end forming a U-shaped throat along one side of said plate, a second bent portion at the end opposite said one end slightly inclined relative to the flat surface of the plate in the direction opposite said throat, a cable secured at one end to said plate at an intermediate portion between both of said ends, said intermediate portion being located in the direction of said second bent portion relative to the center of gravity of the plate, said one end of said cable forming a closed loop having an aperture adjacent the plate and on the same side of the plate as the throat, whereby said loop and said throat are adapted to upstandingly retain said rod while the latter is impacted for driving the anchor into the ground, and said plate is adapted to tilt about said loop when the cable is pulled upwardly thereby imparting a plowing effect of said plate in the ground.

2. A ground anchor as recited in claim 1, whereby the second bent portion form a continuous curve with the surface of the plate, said curve having a leading edge displaying a tangential angle of about 15 to 30 degrees with the flat plate.

3. A ground anchor as recited in claim 2, whereby said plate is provided with a pair of holes across said intermediate portion for receiving and holding said loop.

4. A ground anchor as recited in claim 3, wherein said loop comprises a clip for gripping said end of the cable to a portion of the cable adjacent said end of the cable.

5. A ground anchor as recited in claim 3, including a rod having one end shaped for fittingly abutting into said throat and a cross-section for fittingly sliding through said loop.

* * * * *